US008758169B2

(12) United States Patent
Ichikawa et al.

(10) Patent No.: US 8,758,169 B2
(45) Date of Patent: Jun. 24, 2014

(54) METHOD AND SYSTEM FOR GOLF BALL FITTING ANALYSIS

(75) Inventors: Yasushi Ichikawa, Tualatin, OR (US); Hideyuki Ishii, Portland, OR (US); Yutaka Kabeshita, Portland, OR (US); Nicholas A. Leech, Aloha, OR (US); Arthur Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 968 days.

(21) Appl. No.: 12/498,364

(22) Filed: Jul. 7, 2009

(65) Prior Publication Data

US 2011/0009215 A1 Jan. 13, 2011

(51) Int. Cl.
*A63B 57/00* (2006.01)
*A63B 69/36* (2006.01)

(52) U.S. Cl.
CPC ..... *A63B 69/36* (2013.01); *A63B 57/00* (2013.01)
USPC ..... 473/407

(58) Field of Classification Search
CPC .... A63B 37/0003; A63B 57/00; A63B 69/36; A63B 2243/0029; G09B 19/0038
USPC ..... 473/131, 278, 407, 409
See application file for complete search history.

(56) References Cited

U.S. PATENT DOCUMENTS

| | | | | |
|---|---|---|---|---|
| 4,375,887 | A | 3/1983 | Lynch et al. | |
| 5,766,097 | A | 6/1998 | Horiuchi et al. | |
| 5,967,906 | A | 10/1999 | Horiuchi et al. | |
| 6,086,487 | A * | 7/2000 | Morgan et al. | 473/407 |
| 6,672,978 | B1 | 1/2004 | Morgan et al. | |
| 6,794,447 | B1 | 9/2004 | Kim et al. | |
| 7,384,352 | B2 | 6/2008 | Ohama et al. | |
| 7,396,301 | B2 | 7/2008 | Ohama et al. | |
| 7,410,430 | B2 | 8/2008 | Isogawa et al. | |
| 7,908,907 | B1 * | 3/2011 | Nelson et al. | 73/65.03 |
| 2002/0152796 | A1 | 10/2002 | Katayama | |
| 2004/0006442 | A1 | 1/2004 | Boehm | |
| 2006/0030422 | A1 * | 2/2006 | Rankin et al. | 473/287 |
| 2007/0244667 | A1 | 10/2007 | Ligotti, III et al. | |
| 2008/0039236 | A1 | 2/2008 | Isogawa et al. | |

(Continued)

FOREIGN PATENT DOCUMENTS

| | | |
|---|---|---|
| JP | 2002000787 | 1/2002 |
| JP | 2006031430 | 2/2006 |
| JP | 2006075210 | 3/2006 |
| KR | 10-2007-0106850 | 11/2007 |

OTHER PUBLICATIONS

Korean Prior Art Search Report dated Jul. 30, 2010 in Korean Patent Application No. 10-2010-0065042.

(Continued)

*Primary Examiner* — David L Lewis
*Assistant Examiner* — Robert Mosser
(74) *Attorney, Agent, or Firm* — Plumsea Law Group, LLC

(57) ABSTRACT

The present invention provides three golf ball recommendations correlating to ball fit values calculated using subject criteria, objective criteria and a composite fit value employing both subjective and objective criteria. The concept of the invention is to attempt to quantify even the subjective parameters of golfer's game and answers to survey questions in order to provide an avenue for quantitative analysis for golf ball fitting. The ball fit values are a construct based on a scale devised for this method to quantify how difficult or easy a golf ball is to play.

7 Claims, 10 Drawing Sheets

(56) References Cited

U.S. PATENT DOCUMENTS

| | | | |
|---|---|---|---|
| 2009/0054175 | A1 | 2/2009 | Isogawa et al. |
| 2009/0054176 | A1 | 2/2009 | Isogawa et al. |
| 2009/0082137 | A1 | 3/2009 | Okabe |

OTHER PUBLICATIONS

European Search Report dated Nov. 3, 2010 in European Patent Application No. 10 16 8501.

Canadian Office Action dated Oct. 21, 2010 in Canadian Patent Application No. 2,706,694.

Canadian Office Action dated Jun. 15, 2011 in Canadian Patent Application No. 2,706,694.

Canadian Office Action dated Apr. 5, 2012 in Canadian Patent Application No. 2,706,694.

Australian Office Action dated Apr. 6, 2011 in Australian Patent Application No. 2010202711.

* cited by examiner

Golf Ball Categorization / Grading

| | Difficult ---------- Easy | | | | |
|---|---|---|---|---|---|
| Parameter | 1 | 2 | 3 | 4 | 5 |
| Driver Spin | Easy to Spin | | | | Less Easy to Spin |
| Consistency of Swing | Requires Consistency | | | | More Forgiving |
| Side Spin | Easy to Spin | | | | Less Easy to Spin |
| Attack Angle | Shallow | | | | Steep |
| Launch Angle | Low | | | | High |

BALL A

BALL B

BALL C

METHOD AND SYSTEM FOR GOLF BALL FITTING ANALYSIS

BACKGROUND OF THE INVENTION

1. Field of the Invention

The present invention relates to a method and system for golf ball fitting analysis to match golf balls to a golfer's game and proficiency.

2. Description of Related Art

With advances in golf ball design, and increasing awareness and proliferation of golf equipment designed for particular levels of play, there has been increased interest in matching a golfer with an appropriate golf ball. While golf club fitting has become well known and a routine service of golf pro shops, golf ball fitting is a newer process with much still being done simply by a series of questions posed to the golfer. The questions are generally about a golfer's average score, handicap, their goals for their game, and their wishes for the oft times contradictory goals of control, distance, workability of the golf ball. In some golf ball fitting surveys, there is consideration given to the playing conditions such as green speeds, firmness of the turf, altitude, climate and atmospheric conditions on a given course. After the answers are elicited, a pro or fitter will consider the necessary compromises and recommend a golf ball for the player. This question and answer process is purely subjective and does not take much measurable criteria into account. A golfer's stated average score or handicap is simply accepted. It does not take into account the fact that golfers may subconsciously provide answers regarding distance, control, how often they tend to slice the ball, etc. that they wish were true rather than those that are true.

Recent developments in golf ball fitting have addressed some of the shortcomings of a purely subjective question and answer process by having a golfer take swings at a ball while being monitored by launch monitors, video devices and other measuring devices. The measurements generally taken range among the club head speed, ball speed, launch angle, attack angle, backspin, sidespin and total distance. In existing ball fitting methods, these measurements are considered within a framework of assumptions. It is known that when a golf ball is hit by a driver, fairway metal or long iron, the ball is deformed upon impact, and that large deformation means less spin and longer carries. An example of an assumption of a conventional ball fitting method is that distance is maximized when a ball is selected to provide an appropriate amount of deformation for one's specific golf swing. In this existing ball fitting method, the golf balls are categorized primarily according to spin and feel, and the measurements and survey questions are used to recommend a golf ball using this type of two-dimensional ball profile. The existing ball fitting methods require a degree of knowledge and subjective judgment of the tester in employing the measured parameters to arrive at a recommendation.

In both the survey approach and the measurement and testing approach, a wide range of parameters and inputs would be preferred. However, in the context of a ball fitting session, a challenge is to gather a large amount of information in a relatively short amount of time without inconveniencing the golfer. Another challenge is to present the correlation between the information gathered and the recommended golf ball(s) in an easily understood way.

There is a need in the art for a method and system for golf ball fitting analysis that addresses the shortcomings of the prior art discussed above. Specifically, a method that will eliminate the need for a tester to have deep knowledge or experience in order to process a golf ball fitting session. There is also a need to attempt to quantify the subjective parameters in order to compare and contrast the recommended ball based on the subjective criteria and the recommended ball based on objective criteria. The correlation will provide insight into the questions used in the survey and help to fine tune those questions to coincide more with a golfer's actual game, ability and swing mechanics. There is also a need to meld together or reconcile a golfer's perceptions of their game and ability with the reality of their swing and ball striking ability, and then to present a correlation that is easy to understand. This type of understanding of their game and their perception will hopefully lead not only to a better matched golf ball, but also a better understanding of how they can improve as a golfer.

SUMMARY OF THE INVENTION

A method and system for golf ball fitting analysis that uses a predetermined scale for profiling a group of golf balls and compares the scale values with both subjective and objective criteria to formulate a golf ball recommendation using three different values: a subject ball fit value, an objective ball fit value and a composite ball fit value. This is attained by predetermining a golf ball fit value scale to be used for both profiling golf balls in a test group, and for assigning scale values that correlate to subjective input and objective measurements. The golf ball profiles are stored in a lookup table or database for comparison with the ball fit values determined or calculated by the method and system of the invention. These are compared and the closest match is determined to be the recommended ball. The present invention contemplates a recommendation based on the subjective criteria alone; another recommendation based on the objective criteria alone; and yet another recommendation based on a composite of the subjective and objective criteria. This could be calculated as a pure average of the ball fit values, or a weighted average as dictated by testing conditions or fine tuning of subjective criteria.

Another aspect of the invention is the use of multiple measured parameters all correlated to the same scale so as to graphically represent the ball profiles in the test group and graphically represent the ball fit value for a golfer's swing. The graphic representations are compared to determine the closest ball profile corresponding to the golfer's swing. In this manner, an easily understood result is displayed for the golfer to confirm the ball recommendation and use as an instructional aide for improvement.

In another aspect of the invention, a computer or server containing the program to run the analysis has access to or is linked to a database containing golf course information such as altitude, climate and weather conditions to provide another parameter for golf ball fitting.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION OF THE PREFERRED EMBODIMENTS

Figure 1:
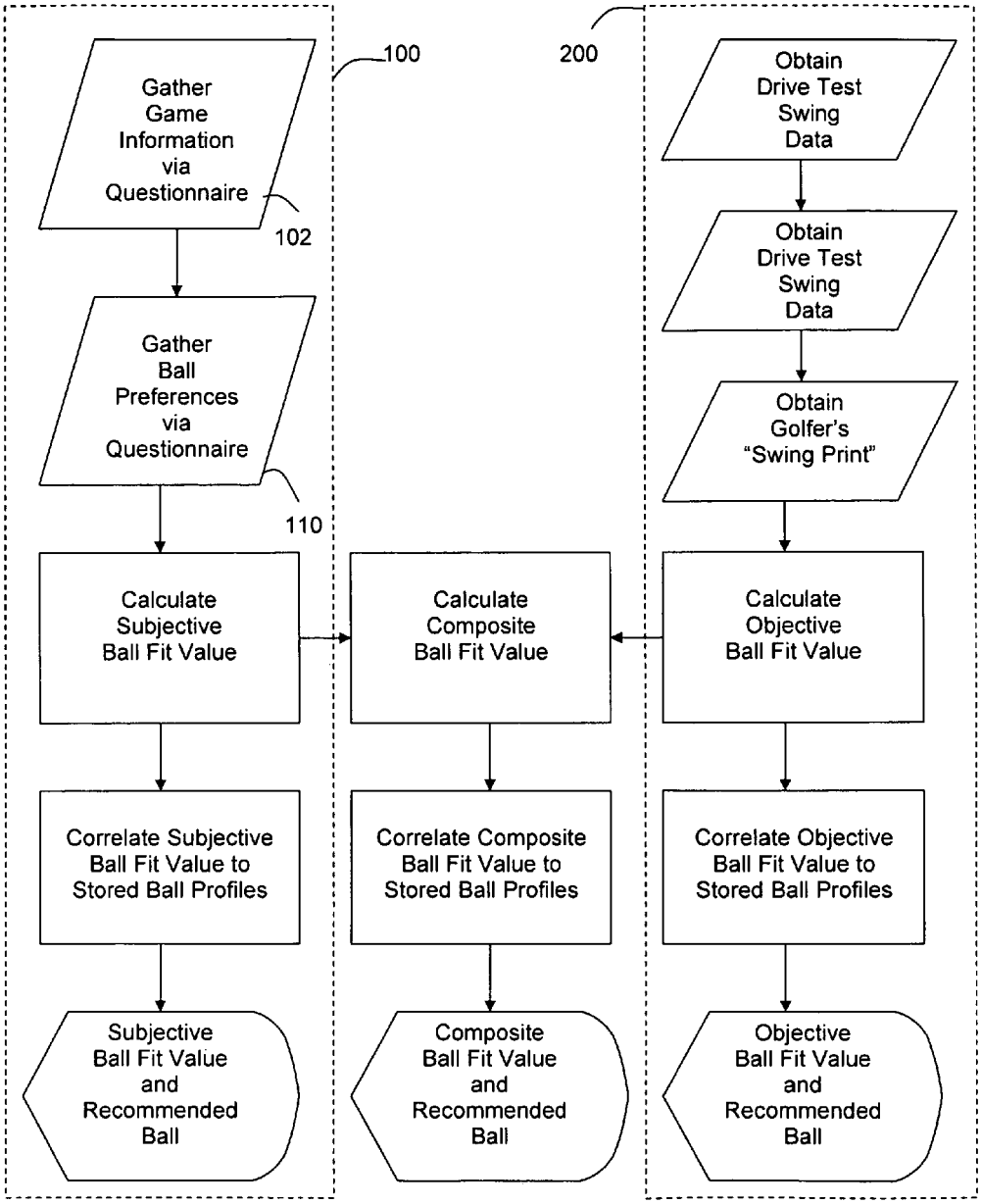
FIG. 1 a flow diagram of the overall process for the method and system for golf ball fitting analysis according to the present invention.

An overview of the golf fitting analysis method of the present invention is shown in FIG. 1. Put succinctly the present invention provides three golf ball recommendations correlating to ball fit values calculated using subject criteria, objective criteria and a composite fit value employing both subjective and objective criteria. In FIG. 1, section 100 of the diagram represents the subjective criteria portion of the method, and section 200 represents the objective criteria portion of the method. In the center, the subjective and objective fit values are used to calculate a composite fit value. Overall, the concept of the invention is to attempt to quantify even the subjective parameters of golfer's game and answers to survey questions in order to provide an avenue for quantitative analysis for golf ball fitting.

Figures 3, 4:
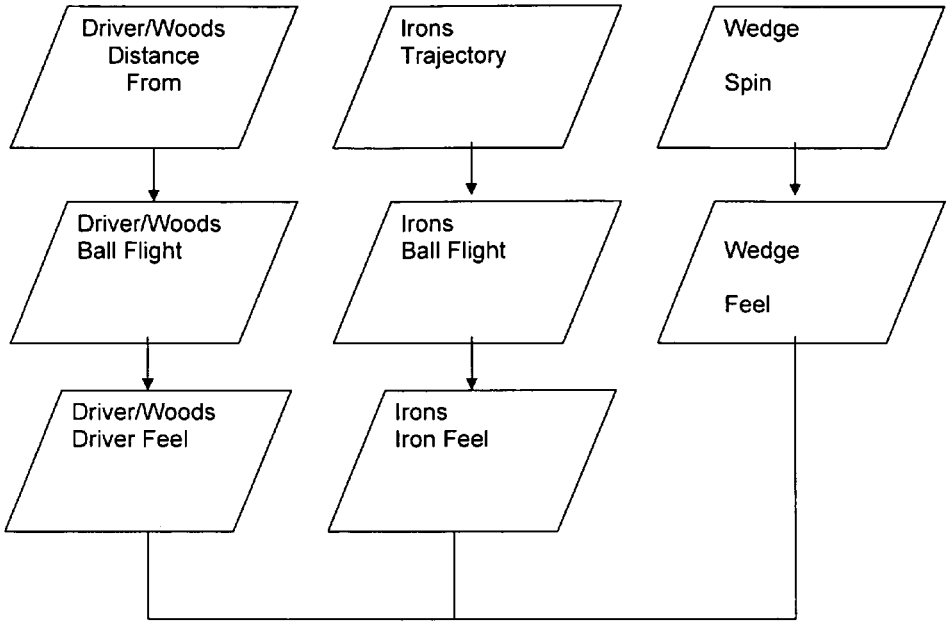
FIG. 3 is a flow diagram of the type of ball preference information gathered in the process.
FIG. 4 is a table containing the parameters for grading or profiling golf balls in a test group.

The ball fit values are a construct based on a one to five scale devised for this method to quantify how difficult or easy a golf ball is to play. This one to five scale is shown in FIG. 4 along with parameters for golf balls: driver spin, consistency of swing, side spin, attack angle and launch angle. These parameters are objective parameters which are easily measured as detailed later in the specification. This scale ranging from one being more difficult to play and five being easier to play is used throughout to quantify even the subjective criteria to the extent possible.

Figure 2:
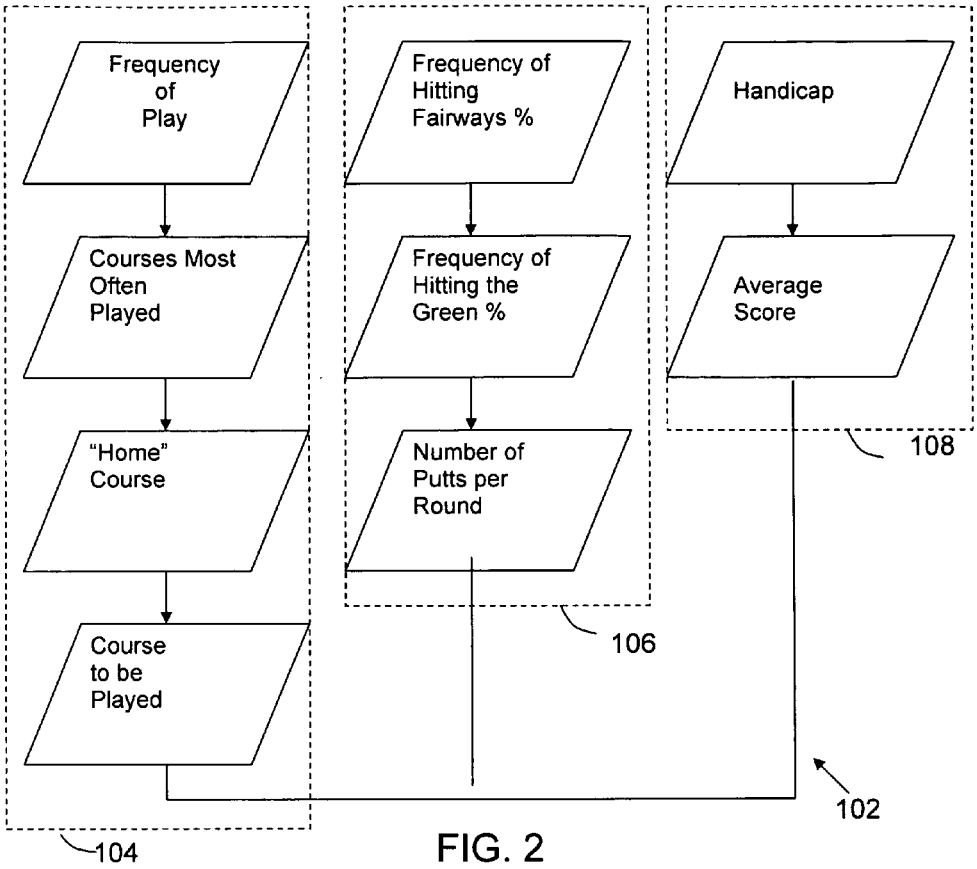
FIG. 2 is a flow diagram of the type of game information gathered in the process.

Specifically in FIG. 1, input 102 represents the gathering of a golfer's game information using a questionnaire or survey of some sort. FIG. 2 provides a detailed diagram representing possible questions for input 102 separated into three sections: frequency of play and course component 104, game consistency component 106 and score component 108. The components most amenable to quantification are the game consistency component 106 and the score component 108. A lookup table or database with ranges correlating to a one to five scale based perhaps on five categories of proficiency such as beginner, amateur (high handicap), intermediate (mid handicap), advanced or scratch (low handicap), and pro could be used to quantify these components. These criterion are considered subjective in the sense that a golfer provides the information in response to questions and that no confirmation of average score, for example, is taken. Various other methods of applying a one to five scale can be used to quantify the components in input 102.

In play and course component 104, the courses most often played and the course to be played are not necessarily subject to grading or scaling, however could be used as additional parameters for golf ball fitting. It is contemplated that a golf course database could be created containing course climate and altitude conditions with a lookup to real time weather conditions using an internet weather website could be integrated into the golf course database as another input into the golf ball fitting method. Since climate, altitude and weather conditions how a golf ball plays, golf ball recommendations that take these into account could be integrated with present system and method. This may also be useful for golfers who are traveling to play courses with which they are unfamiliar. For example if a golfer's home course is in Ohio but travel calls for playing in a higher elevation like Denver, an adjusted golf ball recommendation may be in order. Similarly, if a golfer's home courses are in a rainy, humid climate such as Houston, but travel calls for playing in an arid climate like Tucson, an adjusted golf ball recommendation may be in order. This adjustment could be a separate output that is triggered only when a course to be played is input or requested.

In FIG. 1 input 110 represents the gathering of the golfer's ball preference information, and the details are shown in FIG. 3. The ball preferences are categorized performance from driver/woods, irons and a wedge. These performance criteria are purely subjective as they relate to a golfer's preferences only. A one to five scale is applied to these criterion perhaps by categorizing the preferences in terms of what a high handicap golfer may prefer versus what a low handicap golfer may prefer. For example, for a wedge, a low handicap golfer would likely prefer more spin since such an advanced golfer is able to control their swing to impart the spin they want. Therefore a preference for high spin from a wedge would correlate to a golf ball that is more difficult to play and rated a one or closer to one on the scale of the present invention. Another example of applying the scale is in the ball flight for the driver/woods and irons in which an advanced golfer would likely prefer a more workable ball while a high handicap golfer would likely prefer a straighter flight ball. This goes to the level of control they have so that a more workable preference for ball flight is likely a more difficult ball to play and therefore a one or closer to a one on the scale.

Similarly for the feel of the golf ball off of all three types clubs, the scale could be employed to rank the correlation between softness and degree of difficulty. This is necessarily an imperfect correlation in theory because of the subjective nature of a golf ball's feel and golfers' individual preferences. It is contemplated that the imperfection of correlating the softness feel and degree of difficulty of a golf ball can be addressed and resolved iteratively as ball fitting data is collected and analyzed over time to determine how most golfers note their preferences and comparing those preferences to those same golfers' swings, scores and other data. Initially one approach may be to assume that a low handicap golfer likely would prefer a softer feel compared to a high handicap golfer who is likely to prefer a firmer feel in order to gain distance and other compensating characteristics. Therefore on the one to five scale, a preference for a softer feel will be a one or closer to one and a preference for a firmer feel will be a five or closer to five. However another approach that is contemplated may be to assume that a golfer with a high club head speed, regardless of handicap, may prefer a harder ball because the high club head speed compresses a "soft" ball too much and feels too mushy to the golfer. If the assumption for the correlation is based on club head speed rather than handicap, then on the one to five scale, a preference for a softer feel would be a five or closer to five and a preference for a harder feel would be a one or closer to one. In practice, it is possible that grading or scoring a golf ball's feel may be an amalgam of factors such as handicap and club head speed whose correlation will be honed and informed by analyzing data from larger sample sizes of golfers who complete a ball fitting process. As with any survey, studying the results with an eye to the questions themselves as well as subtleties such as the order of the questions, and how they are sequenced can provide valuable insight into how to improve the questionnaire to attain the answers most useful for the ball fitting analysis.

For any of these ball grading criteria, using the scale, the range can be divided between one to five in any appropriate gradation and the golfer's preferences correlated in accordance with the general understanding in the art.

FIGS. 2 and 3 address the subjective parts of the ball fitting process and with the quantification using the one to five scale, the values can be averaged to calculate a ball fit value based on the subjective criteria. A pure average is contemplated, but it is also within the purview of the invention to use a weighted average of the criterion as the method evolves and as the criterion are fine tuned.

The ball fit value that is calculated is then correlated to the ball profiles of the test group of balls. The ball profiles or grades are also calculated using the same one to five scale of difficulty as shown in the table in FIG. 4.

In the present method golf balls are graded or profiled using at least the five categories as shown in the table in FIG. 4. While an understanding of these parameters is well within the purview of a person of ordinary skill in the art, a short explanation of each is provided herein for completeness.

Driver spin refers to backspin imparted to the ball at impact. High spin golf balls are designed to produce a lot of ball spin while in the air. A high spinning ball will product a longer carry due to the backspin at impact, and it will not get much run on the fairways. However, a high spinning ball is advantageous on the greens as it provides a proficient golfer a little more control because they know how to strike the ball to impart the spin they want. High spin balls are generally used by lower handicap layers to take advantage of these characteristics. On the other end of the spectrum are low spin golf balls specifically designed to minimize the amount of spin as it travels through the air. These low spin balls will help eliminate side spin which means it minimizes the chances of slicing or hooking the ball. A low spin ball will tend to fly straighter through the air, but may not travel as far as a high spin ball. This is compensated somewhat when the ball hits the ground as it will roll further and not spin back. Low spin balls are designed for higher handicap players as they enable a straighter shot in the air and also run out on the fairways. Mid spin golf balls fill the gap between the high and low spin balls and are designed to optimize both feel and distance. Golfers with mid range handicaps may find these balls offer the right compromise between distance and control. In the context of spin, as seen in FIG. 4, golfers refer to balls as hard to play or easy to play based on how easy it is to impart a spin on the ball. High spin balls are generally considered more difficult to play and low spin balls are considered easier to play.

The consistency of swing parameter simply refers to whether a ball requires a player's swing to be very consistent to impart the same flight and control, or whether a ball is more forgiving of a player's swing consistency.

The side spin parameter is tied to the driver spin parameter in that the same characteristics of a golf ball are in play. A high spin ball will be easier to impart a side spin which means the chances of slicing or hooking the ball are increased. A low spin ball is designed to be less easy to spin and therefore is more forgiving of a sliced or hooked strike.

The angle of attack represents the angle of the club head's path as it travels toward, and then makes contact with, the golf ball. The angle of attack is determined by the golfer's swing mechanics. As a reference point most golf instruction refers to a zero angle of attack as meaning that the club head is traveling level with the ground at impact. This is sometimes called a sweeping angle of attack. A golfer's swing is much more likely to produce a positive angle of attack, that is, traveling below the ball and moving up through impact, or a negative angle of attack, that is, coming down at the golf ball and moving below the ball after impact. Therefore a "flatter" swing will generally improve both distance and accuracy with a driver. A shallow angle of attack results in a more solidly hit ball with less spin producing a longer and straighter shot. Divots are one way golfers review their angles of attack when hitting with their irons, since a golfer who hits with a shallow angle of attack will generally leave shallow divots while a golfer who hits with a steeper angle of attack will generally leave deeper divots. Proficient players such as Tour players will generally have a shallow angle of attack, and higher handicap players will generally have a steeper angle of attack. Golf balls are designed to help compensate for these swing mechanics as shown in the range in FIG. 4.

Launch conditions refer to how the ball comes off of the clubface at impact. For distance, there are three launch conditions that matter: (i) how fast the ball is going, the initial velocity, (ii) how much backspin it has, the driver spin rate; and (iii) its angle upward, the launch angle. The initial velocity depends on club head speed which depends on swing mechanics to some degree and the golfer's strength to some degree. Research has shown that for a given club head speed, there is an optimal driver spin rate and launch angle to maximize distance. Distance increases with higher launch angle and less backspin. Launch angle is measured in degrees above the horizontal, and referring to FIG. 4, a ball that is designed to loft higher at impact will be considered a ball that is easier to play than a ball that has a low launch angle for given strike.

Figure 11A:
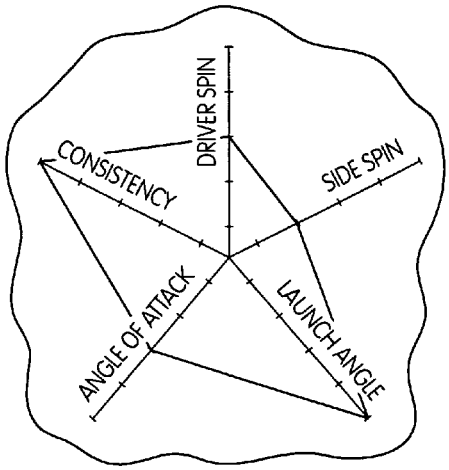
FIG. 11A is a graphical representation of the profile of Ball A in the test group graded according to the table in FIG. 4.
Figure 11B:
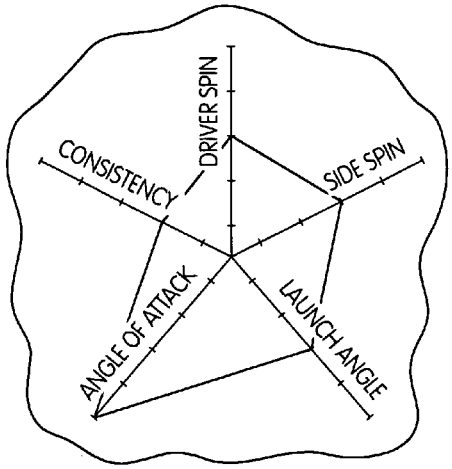
FIG. 11B is a graphical representation of the profile of Ball B in the test group graded according to the table in FIG. 4.
Figure 11C:
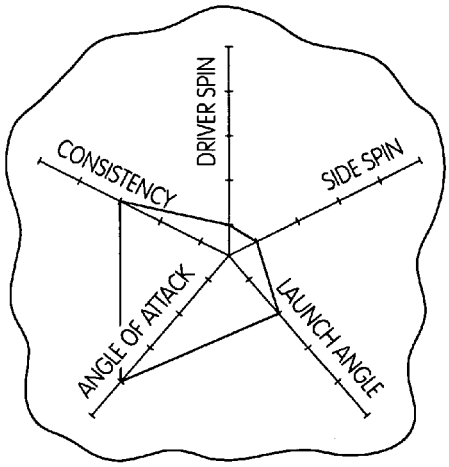
FIG. 11C is a graphical representation of the profile of Ball C in the test group graded according to the table in FIG. 4.

Using these parameters, the balls in the test group are rated or graded using the one to five scale as shown in FIG. 4. For convenience this application will assume that three balls are in the test group: Ball A, Ball B and Ball C, and that each has a different profile. The profiles for the test group using these five parameters are shown graphically in FIGS. 11A, 11B and 11C respectively as they may be displayed on a computer monitor. The wavy boundary around each profile is intended to depict that the graphic is on a portion of a computer display.

While there is necessarily some subjectivity to assigning the values to the test group of balls, it is contemplated that the ball profiles will be completed by the manufacturer or another expert and then stored in a database or lookup table so that the ball fitter or tester need not apply any subjective judgment to the ball correlation or recommendations. This is to address the problem of improperly trained testers or testers without sufficient knowledge providing faulty recommendations to players. Providing an expertly prepared set of ball profiles on the same scale will enable the method and system to be used by any pro shop or retail personnel with minimal additional training and supervision. This enable the ball fitting process to be used more broadly than is currently possible to enable more golfers to have their game analyzed for proper ball fit.

Referring again to FIG. 1, the right hand side section shows inputs 200 which are the objective or measurable inputs for golf ball fitting analysis. A series of swing data tests can be conducted with the golfer taking swings and having their mechanics and ball strike measured with various machines. As currently contemplated, a drive test is conducted to gather swing data. Another swing data test will be conducted to measure the attack angle of the club as seen in the second input box. Yet another set of data that is contemplated to be gathered is coined the golfer's "swing print" in the third input box which is an attempt to capture a golfer's swing mechanics. Examples of the parameters that could be used to determine a golfer's swing print include, but are not limited to, launch condition, attack angle, weight shift, grip pressure, swing tempo, club head speed, among others. These can be measured by various devices and the data input into the ball fitting process. All of the input data is either input into the computer or auto-populated from the measurement devices relaying the measurements to the computer directly in order to calculate a ball fit value based on the objective criteria. The same correlation step is used as in the subjective calculation to correlate the ball fit value to a recommended golf ball using the stored ball profiles. The golfer is then provided with the recommended ball from the test group based on the measured data.

In the center part of FIG. 1 is another aspect of the invention in which the ball fit values from the subjective calculation and the objective calculation are used to calculate a composite ball fit value. This could be a pure average of the two fit values or a weighted average which could be determined as the method evolves to include or exclude some parameters and as some parameters show themselves to be more important or less important than others in predicting overall improvement due to ball fit. The composite ball fit value is compared with the stored ball profiles of the test group and a correlation made to the closest to determine the recommended ball. By this method a golfer is given at least three outputs: a recommendation based on subjective information, a recommendation based on objective information and a recommendation based on a composite of the subjective and objective criteria. It is possible that the results could be the same ball for all three recommendations; as is possible that a different ball is recommended for each of the three calculations. Another possibility, which may occur more frequently is that a ball correlates to two of the ball fit values and a different ball correlates to the third ball fit value.

Figure 5:
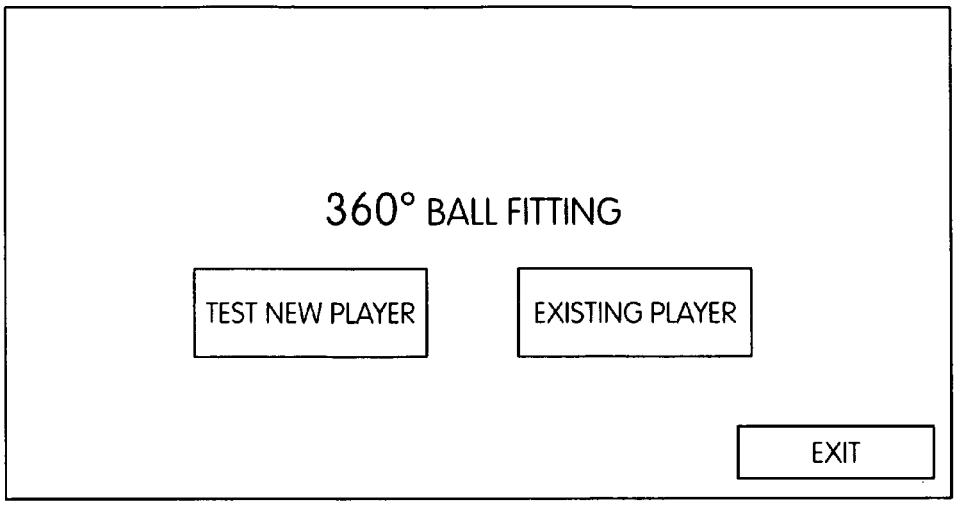
FIG. 5 is a sample screen shot of a computer display running a golf ball fitting session in accordance with the present invention.
Figure 6:
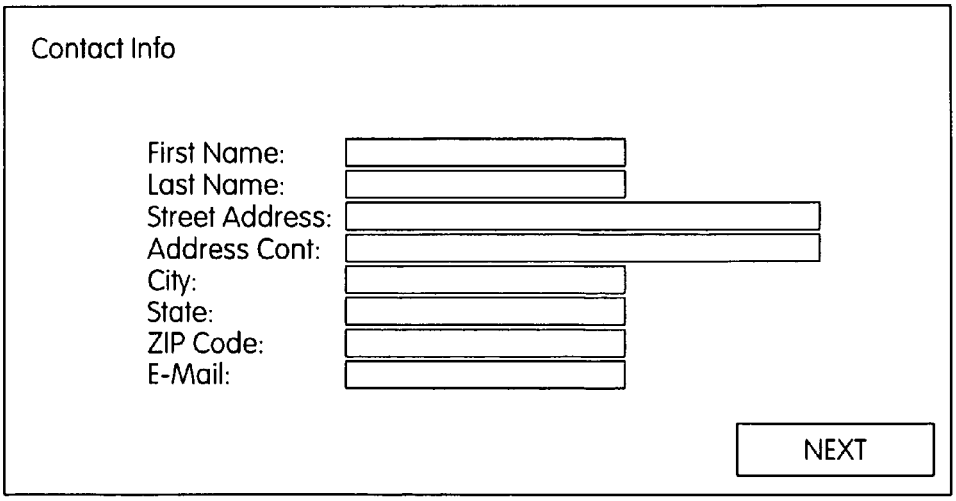
FIG. 6 is a sample screen shot of a golfer's contact information screen.
Figure 7:
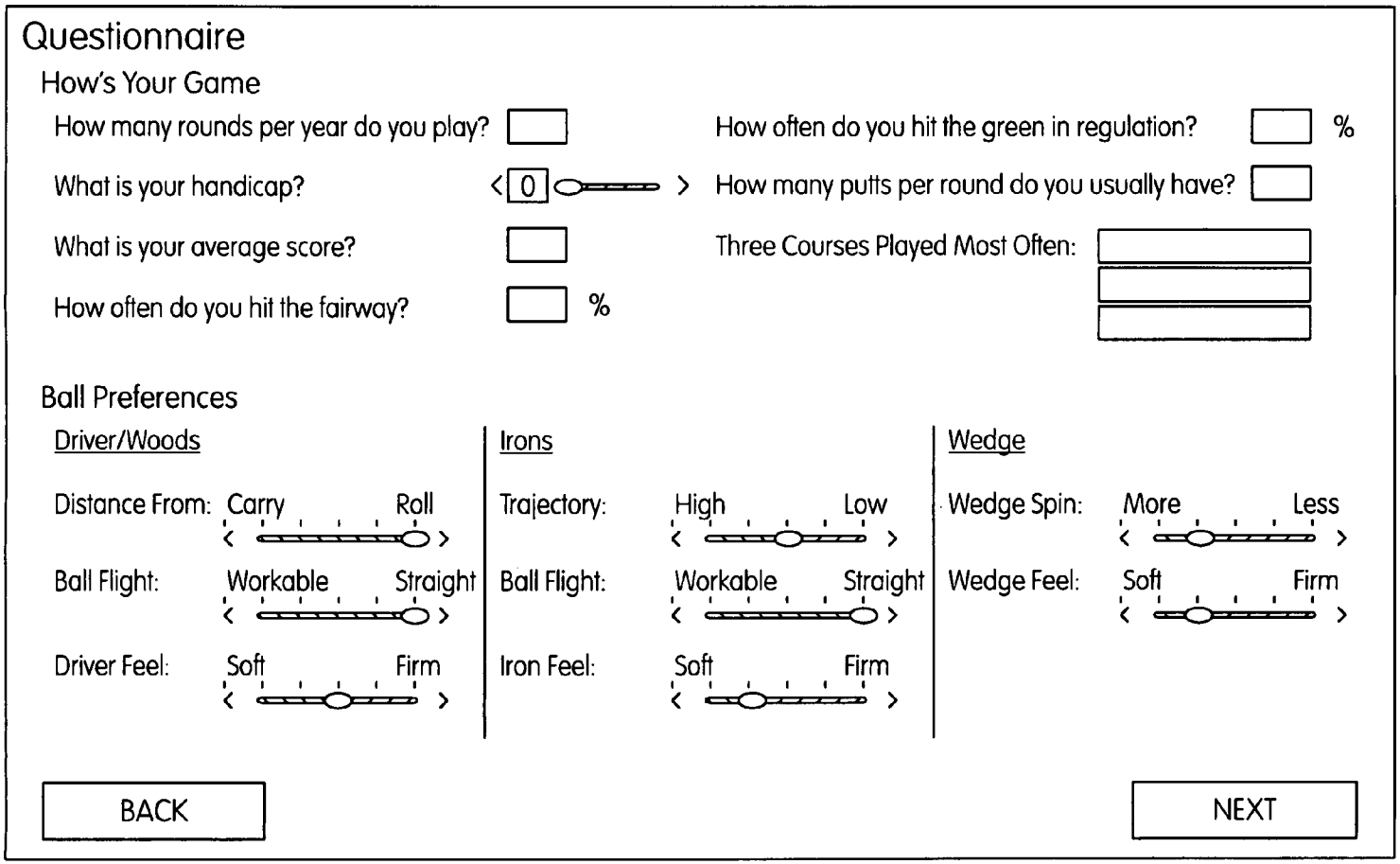
FIG. 7 is a sample screen shot of a questionnaire to gather game and ball preference information.

Referring now to FIGS. 5-10, some sample screen shots of a computer display are provided from a computer program for this method. FIG. 5 is a sample entry screen in which the operator can choose between a new player or an existing player. Once one of these choices is made by selecting with a computer mouse, the contact information screen appears, FIG. 6. If an existing player was selected, it is contemplated that entry of the player's first and last name, or some other identifying information field such as the email address could result in the remaining fields being auto-populated. It is also contemplated that an existing player may have their profile stored on the computer database or on a removal media and the computer could retrieve that information to populate the contact information. After the contact information is entered or populated, the operator selects the "Next" icon and a questionnaire screen such as FIG. 7 appears. This sample questionnaire shows the various inputs for the subjective portion of the diagram of FIG. 1. Some fields will be input fields, and other fields could be click and drag fields such as those in which the oval icon can be dragged and positioned along the line or scale shown. These would correlate to the one to five scale. This type of input could also be done via a touch screen interface directly on the computer display instead of with a pointer and cursor interaction.

Although one sample questionnaire screen is shown in the drawings, it is possible that the questionnaire information could be gathered using multiple screens or other types of input methods.

Figure 8:
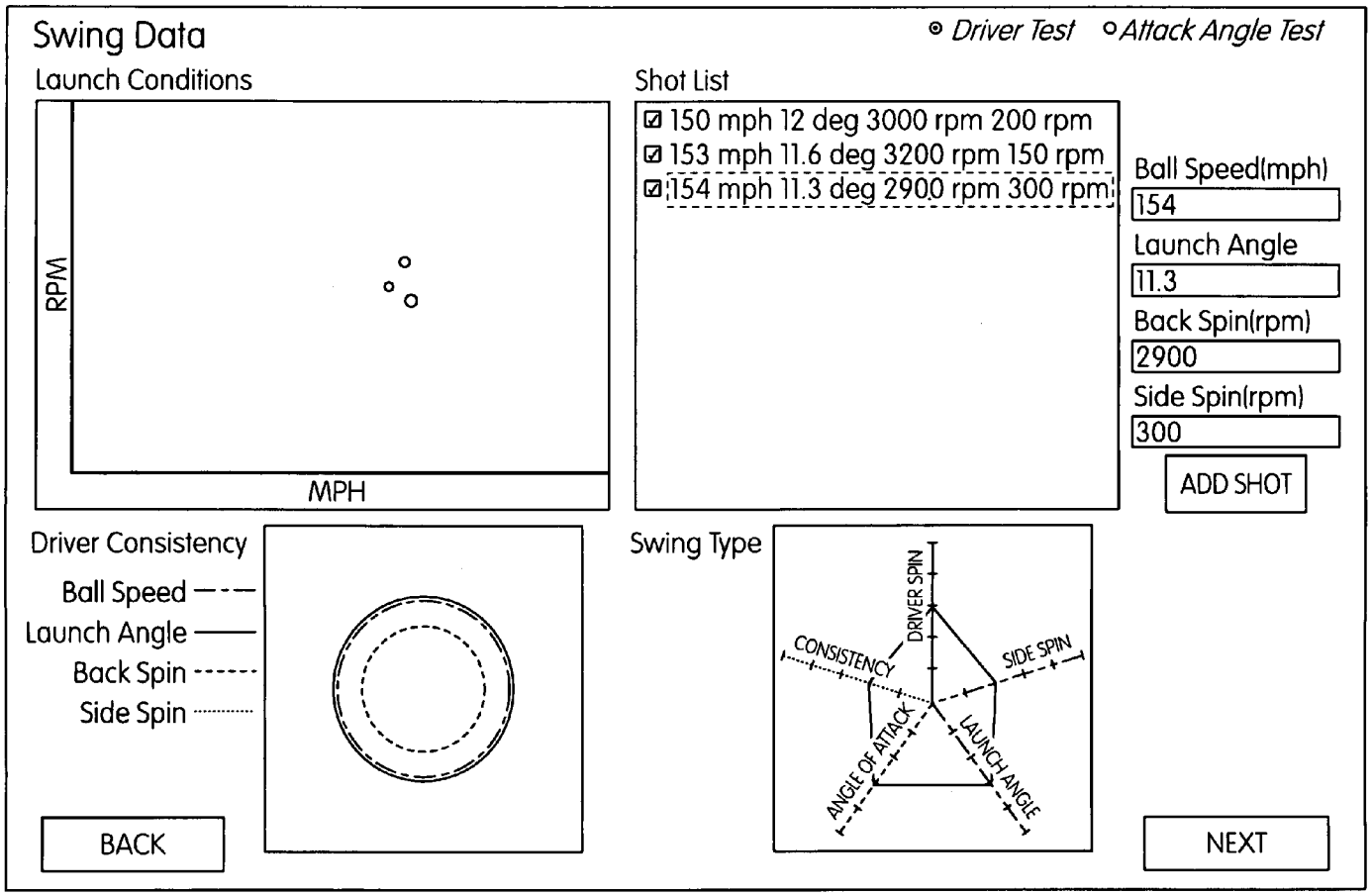
FIG. 8 is a sample screen shot of a driver test showing the swing data obtained.
Figure 9:
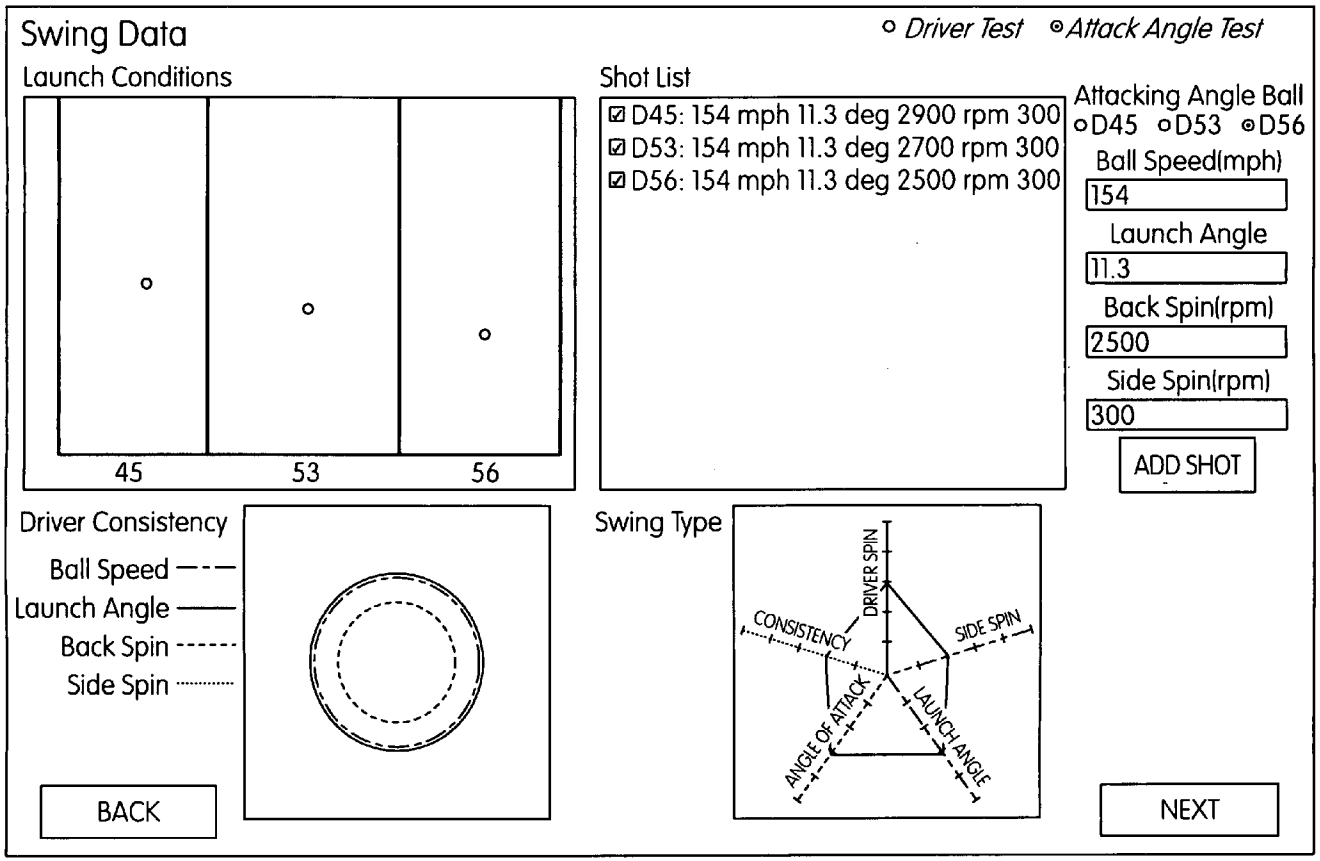
FIG. 9 is a sample screen shot of an attach angle test showing the swing data obtained.

After the questionnaire portion of the ball fitting process, the golfer would be tested for the objective inputs by taking swings in a specially prepared area that has various measurement equipment positioned for use. The swing data screen shots of FIGS. 8 and 9 are generated by using equipment such as a launch monitor to obtain the data and display it on the screen as the test progresses. One test is for the driver swing as shown in FIG. 8 and another test is for the angle of attack as shown in FIG. 9. The graphical representations of the swing data could be used to provide the golfer with a visual correlation of their swing and the recommended ball.

Figure 11D:
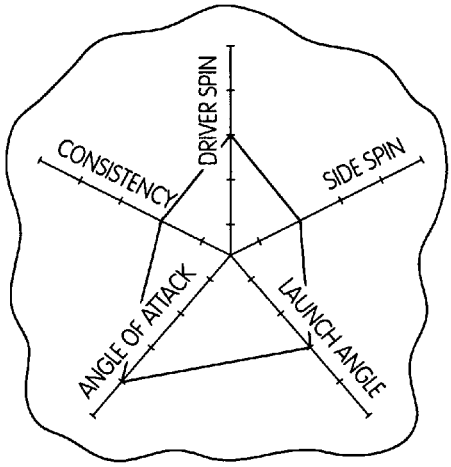
FIG. 11D is a graphical representation of a golfer's swing data.

For convenience in this description, the test group of balls consists of three: Ball A, Ball B and Ball C. The profiles of these balls based on the one to five scale shown in FIG. 4 is also graphically represented in FIGS. 11A, 11B and 11C respectively, with zero being the center of the five axes. As seen in the figures, the graphing of the parameters in this fashion provides a unique shape and potential identifier for the balls. A ball performance profile that is unique that the ball using this scale and that can be likened to a fingerprint or a ball fit print. A possible way to display to the golfer the results of the ball fitting method would be use the graphical representation of their swing test as seen in FIG. 11D and show the correlation to the test group of balls. In this instance if these ball fit prints were displayed together or in overlapping fashion on a computer display it would be easily seen that Ball B, FIG. 11B, has the closest shape to the ball fit print of the golfer, FIG. 11D. This would visually demonstrate to the golfer in an easily understood manner, why Ball B is the recommended ball for their swing as measured the objective criteria. Such graphing of a golfer's swing data could also serve as an instructional aide to show the areas for improvement in their swing and game.

Figure 10:
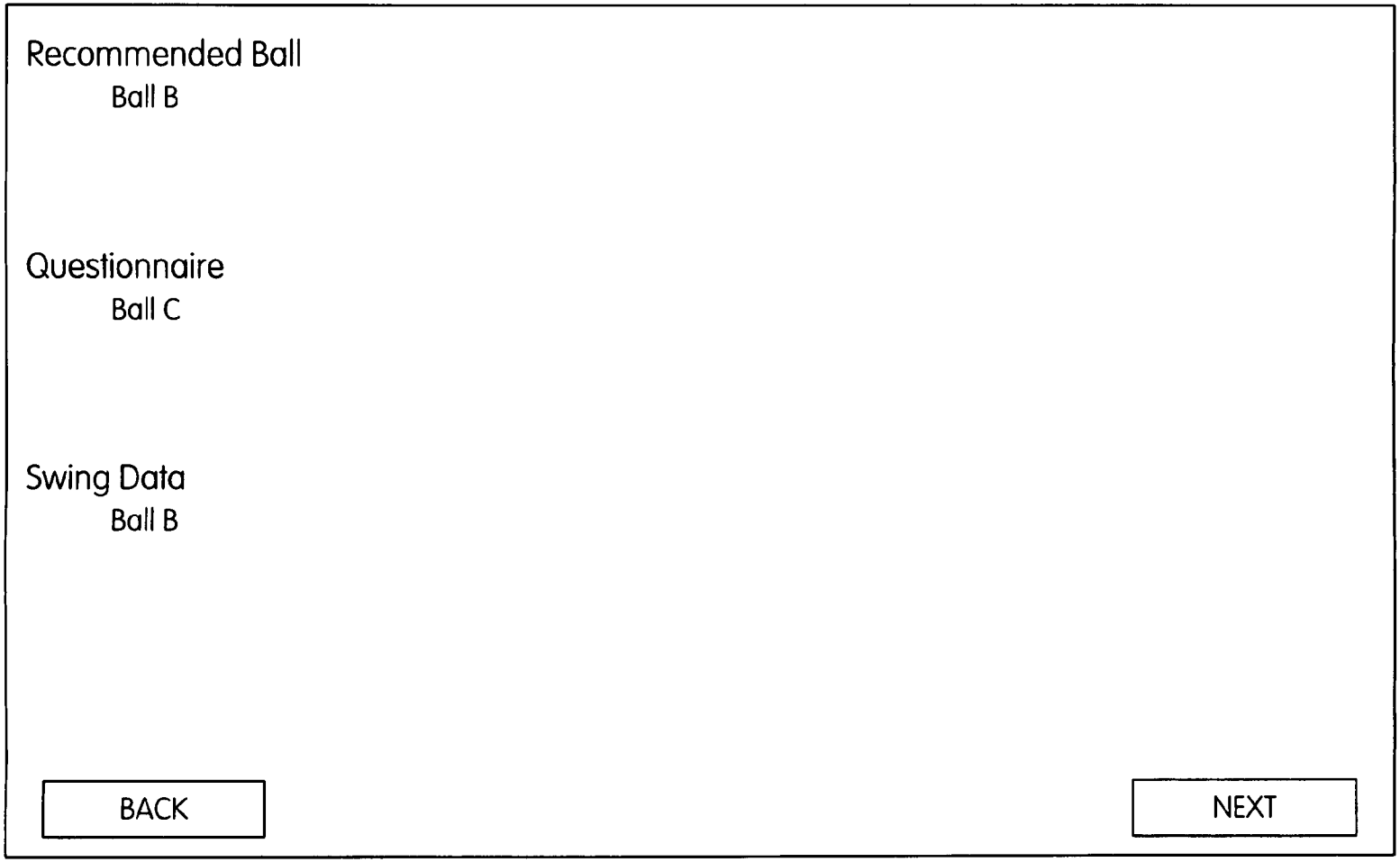
FIG. 10 is a sample screen shot showing the recommended golf balls.

As seen in FIG. 10, a sample screen shot of the results screen shows in this example that Ball B is recommended ball based on the composite calculation. Ball C is the result of the questionnaire. Ball B is also the result of the swing data tests. In addition to the answer screen shown in FIG. 10, a graphical representation of the comparison as discussed above and shown in FIGS. 11A-11D may be helpful and useful to display.

Of course other graphical representations are also possible and completely within the purview of this invention. For example the five parameters could be graphed by bars and a golfer's swing also graphed with bars so show a match or closeness of match with a ball profile. Although five parameters are shown and discussed in detail in this application, it also contemplated that fewer than five or more than five parameters could be used to calculate a ball fit value and graphically represent the results. Also, even though the scale discussed in detail is a numerical range from one to five, it is also within the scope of the invention to modify the scale to have fewer or greater gradations, or a different numerical range. Alternatively the scale could be an alphabetical scale, a color scale or other type of scale and is not limited to a numerical scale. The invention pertains to quantifying subjective criterion and having it done by experts or those with knowledge and storing those results.

Figure 12:
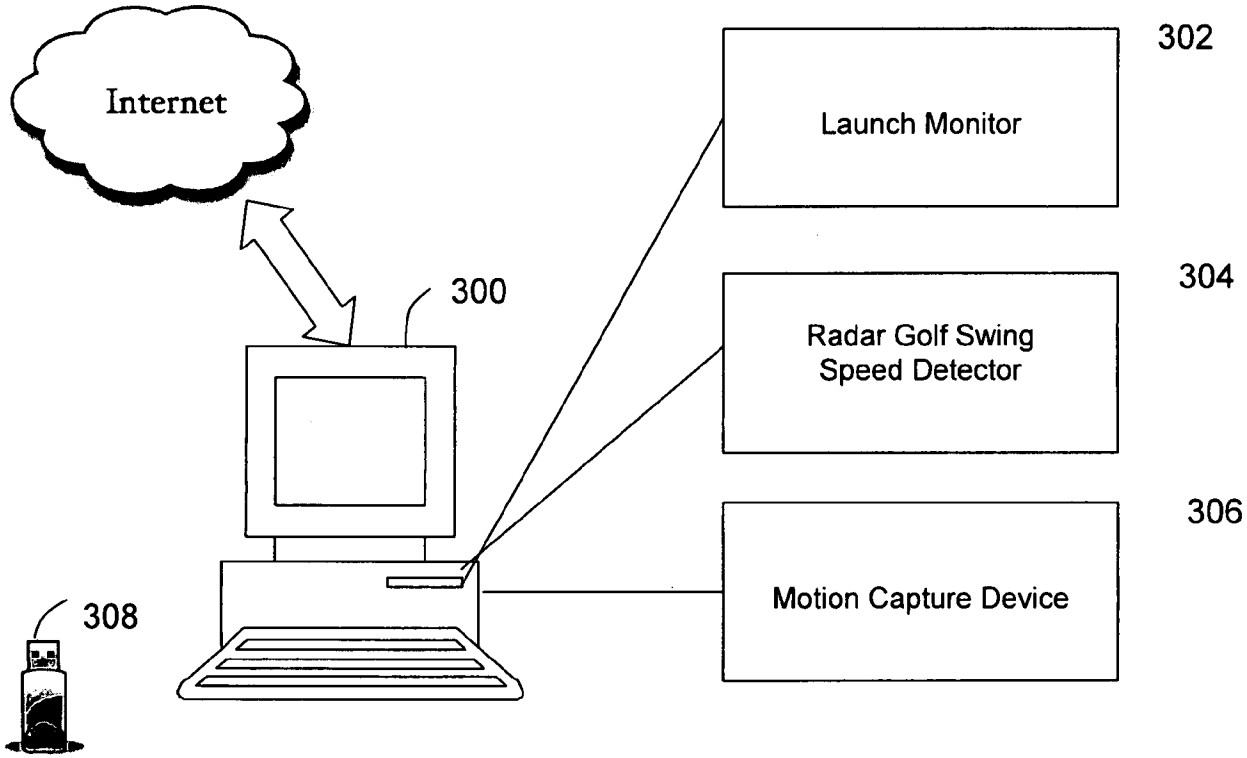
FIG. 12 is a schematic diagram of a system for golf fitting analysis.

FIG. 12 illustrates a schematic diagram of a system for performing the ball fitting method of the present invention. The system comprises a computer 300 running software to collect the inputs and perform the calculations discussed herein. Computer 300 may be functionally connected via hardwire or wirelessly, to various measurement equipment such as a launch monitor 302, a radar swing speed detector 304, a motion capture device 306 or any number of such devices. Even putting monitors could be used to capture the attach angle of the club and launch angle. Various other optical, photographic, infrared, ferro-magnetic or laser sensors or measuring devices are all contemplated to be used to collect the objective data of the golfer.

While the software for the current method could be run on a standalone general purpose computer 300, it is also contemplated that computer 300 could be a server or connected to the internet could be the terminal to use the method online or remotely from where the software resides or is hosted. The computer may also includes a keyboard, a mouse, and a monitor controlled by a display card. The computer also may include a hard disk or other fixed, high density media drive, and a removable media device drive into which a removable magneto-optical media such as a disk is inserted and read and/or written to. These discrete components are connected using an appropriate device bus. The computer may also be connected to a printer (not shown) to provide printed listings of any of the inputs, intermediate calculations, and outputs associated with the estimated option price. Examples of computer readable media present in the system illustrated in FIG. 12 include the memory, the hard disk, and the removable media. Stored on any one or a combination of computer readable media, the present invention includes software for controlling the hardware of the computer and for enabling the computer to interact with a user. The software may include, but is not limited to, device drivers, operating systems and user applications. Computer readable media further includes the computer program product of the present invention for calculating an estimated option price. It is also contemplated that a removable media device such as flash memory 308 could be used with computer 300 to store a golfer's inputs and information. This would enable a golfer to reevaluate after some time has lapsed to determine how their game has changed over time. This would also enable a golfer to prepare to play in a different location with different altitude and climate by changing only those inputs to their stored data. This would also enable portability of their information in case of travel or relocation.

Although the removable memory is illustrated as flash memory, other types of media such as magnetic devices, optical devices, and the like are also within the scope of the invention.

While the software for the current method could be run on a standalone general purpose computer 300, it is also contemplated that computer 300 could be a server or connected to the internet could be the terminal to use the method online or remotely from where the software resides or is hosted. The computer may also includes a keyboard, a mouse, and a monitor controlled by a display card. The computer also may include a hard disk or other fixed, high density media drive, and a removable media device drive into which a removable magneto-optical media such as a disk is inserted and read and/or written to. These discrete components are connected using an appropriate device bus. The computer may also be connected to a printer (not shown) to provide printed listings of any of the inputs, intermediate calculations, and outputs associated with the method. Examples of computer readable media present in the system illustrated in FIG. 12 include the memory, the hard disk, and the removable media. Stored on any one or a combination of computer readable media, the present invention includes software for controlling the hardware of the computer and for enabling the computer to interact with a user. The software may include, but is not limited to, device drivers, operating systems and user applications. Computer readable media further includes the computer program product of the present invention for golf ball fitting analysis. It is also contemplated that a removable media device such as flash memory 308 could be used with computer 300 to store a golfer's inputs and information. This would enable a golfer to reevaluate after some time has lapsed to determine how their game has changed over time. This would also enable a golfer to prepare to play in a different location with different altitude and climate by changing only those inputs to their stored data. This would also enable portability of their information in case of travel or relocation.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method for determining a golf ball fit value executed by a computer, the method comprising the steps of:

predetermining a scale for profiling a group of golf balls;

providing and storing on computer readable media at least one scale value as a profile for each golf ball in a group of golf balls;

inputting subjective criteria to the computer regarding a golfer's play, game and score and determining a subjective ball fit value on the scale representing the subjective criteria;

selecting a first stored ball profile correlating to the subjective ball fit value;

inputting objective criteria to the computer regarding a golfer's swing mechanics and determining an objective ball fit value on the scale representing objective criteria;

selecting a second stored ball profile correlating to the objective ball fit value;

calculating a composite ball fit value according to an algorithm that includes the subjective ball fit value and the objective ball fit value;

selecting a third stored ball profile correlating to the composite ball fit value as the recommended ball; and displaying the recommended ball on a display along with the first stored ball profile and the second stored ball profile.

2. The method of claim 1, wherein said step of inputting subjective criteria comprises the step of providing questions and fill-in answer fields on a computer display screen for user input.

3. The method of claim 1, wherein said step of inputting objective criteria comprises the step of using a launch monitor to measure parameters of the golfer's swing and input measurements.

4. The method of claim 3, wherein said step of inputting objective criteria comprises the steps of measuring driver spin, side spin, launch angle, and angle of attack of a golf ball using the launch monitor.

5. The method of claim 1, further comprising the step of saving the input information and recommended profiles on computer readable media.

6. The method of claim 1, wherein said step of inputting objective criteria comprises the step of retrieving using the computer golf course climate, altitude and weather conditions from a database.

7. A golf ball fitting analysis system for a computer comprising:

a database of stored golf ball profiles using at least one scale value;

an input device for inputting subjective criteria regarding a golfer's play, game and score;

a stored lookup table of subjective ball fit values on the scale corresponding to the subjective criteria;

a selecting device for selecting a first stored ball profile correlating to the subjective ball fit value;

a display for displaying the subjective fit value;

an input device for inputting objective criteria regarding a golfer's swing mechanics from a measurement device;

a device for determining an objective ball fit value on the scale representing objective criteria;

a selecting device for selecting a second stored ball profile correlating to the objective ball fit value;

a display for displaying the objective ball fit value;

stored instructions for calculating a composite ball fit value using the subjective ball fit value and the objective ball fit value;

a selecting device for selecting a third stored ball profile correlating to the composite ball fit value, the selected third stored ball profile being a recommended ball profile; and a display for displaying the composite ball fit value and the recommended ball profile along with the first stored ball profile and the second stored ball profile.

* * * * *